US006540070B1

(12) United States Patent
Conwell

(10) Patent No.: US 6,540,070 B1
(45) Date of Patent: Apr. 1, 2003

(54) WATER BOTTLE ATTACHMENT WITH RELEASABLE CONCENTRATED FLAVOR

(76) Inventor: Christopher J Conwell, 29739 Niguel Rd. #H, Laguna Niguel, CA (US) 92677

( * ) Notice: Subject to any disclaimer, the term of this patent is extended or adjusted under 35 U.S.C. 154(b) by 53 days.

(21) Appl. No.: 09/933,430

(22) Filed: Aug. 20, 2001

(51) Int. Cl.[7] ..... B65D 25/08
(52) U.S. Cl. ..... 206/219; 215/DIG. 8
(58) Field of Search ..... 206/219–222, 206/568; 215/DIG. 8, 227, 228; 222/83, 129; 426/115

(56) References Cited

U.S. PATENT DOCUMENTS 3,441,179 A * 4/1969 Ragan ..... 222/129
4,793,475 A * 12/1988 Itzel ..... 206/219
4,982,875 A * 1/1991 Pozzi et al. ..... 222/129
5,941,380 A * 8/1999 Rothman ..... 206/219
6,435,341 B1 * 8/2002 Nobbio ..... 206/219

* cited by examiner

*Primary Examiner*—Luan K. Bui
(74) *Attorney, Agent, or Firm*—Goldstein & Lavas, P.C.

(57) ABSTRACT

A water bottle attachment with releasable concentrated flavor whereby a liftable spout is provided with a plunger portion. The plunger portion includes a cylindrical upper portion engaged by the cylindrical collar whereby upward movement of the liftable spout will not move the plunger portion and subsequent downward movement of the liftable spout will move the plunger portion downwardly. The plunger portion includes a lower plate, portion whereby the downward movement of the plunger portion will cause the lower plate portion to force a quantity of concentrated flavoring against a breakable seal to such a degree that the breakable seal will break allowing the concentrated flavoring to mix with water within a water bottle.

4 Claims, 5 Drawing Sheets

WATER BOTTLE ATTACHMENT WITH RELEASABLE CONCENTRATED FLAVOR

BACKGROUND OF THE INVENTION

The present invention relates to a water bottle attachment with releasable concentrated flavor and more particularly pertains to allowing a bottle of water to be easily transformed into a flavored drink.

The use of bottle closure accessory devices is known in the prior art. More specifically, bottle closure accessory devices heretofore devised and utilized for the purpose of closing open bottles for dispensing are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,941,380 to Rothman discloses a storage cap with means for dispensing food, such as flavoring, into a typical water bottle. U.S. Pat. No. 4,793,475 to Itzel discloses a closure cap system for storing and dispensing a concentrate component by rotating and severing a line of weakness. U.S. Pat. No. 5,465,835 to Schumacher discloses a two component package comprised of a cap containing a collar with opposite threads that extend into the bottleneck.

While these devices fulfill their respective, particular objective and requirements, the aforementioned patents do not describe a water bottle attachment with releasable concentrated flavor for allowing a bottle of water to be easily transformed into a flavored drink.

In this respect, the water bottle attachment with releasable concentrated flavor according to the present invention substantially departs from the conventional concepts and designs of the prior art, and in doing so provides an apparatus primarily developed for the purpose of allowing a bottle of water to be easily transformed into a flavored drink.

Therefore, it can be appreciated that there exists a continuing need for a new and improved water bottle attachment with releasable concentrated flavor which can be used for allowing a bottle of water to be easily transformed into a flavored drink. In this regard, the present invention substantially fulfills this need.

SUMMARY OF THE INVENTION

In the view of the foregoing disadvantages inherent in the known types of bottle closure accessory devices now present in the prior art, the present invention provides an improved water bottle attachment with releasable concentrated flavor. As such, the general purpose of the present invention, which will be described subsequently in greater detail, is to provide a new and improved water bottle attachment with releasable concentrated flavor which has all the advantages of the prior art and none of the disadvantages.

To attain this, the present invention essentially comprises a cylindrical outer casing adapted for coupling with an open upper end of a water bottle. The cylindrical outer casing has an open upper end and an open lower end. The open lower end is internally threaded for engaging the open upper end of the water bottle. A cylindrical inner casing is disposed within the cylindrical outer casing. The inner casing has an open upper end and an open lower end. The open upper end has a narrow neck portion extending upwardly therefrom. An internal cylinder is disposed within the cylindrical inner casing. The internal cylinder has an open upper end and an open lower end. The internal cylinder has a diameter less than a diameter of the inner casing whereby a flow channel is formed between the internal cylinder and the inner casing. The internal cylinder has a quantity of concentrated flavoring therein. The open lower end has a breakable seal disposed therein preventing a downward flow of the concentrated flavoring. A liftable spout is slidably disposed within the open upper end of the outer casing. The liftable spout has a central aperture therethrough in communication with the flow channel. The liftable spout has a cylindrical collar extending downwardly therefrom into the narrow neck portion of the inner casing. The cylindrical collar has an open lower end. The cylindrical collar has annular ridges extending outwardly from an interior surface thereof. A plunger portion is slidably disposed within the cylindrical collar of the liftable spout. The plunger portion includes a cylindrical upper portion having annular ridges extending inwardly thereof for being engaged by the annular ridges of the cylindrical collar whereby upward movement of the liftable spout will not move the plunger portion and subsequent downward movement of the liftable spout will move the plunger portion downwardly into the internal cylinder. The plunger portion includes a lower plate portion whereby the downward movement of the plunger portion will cause the lower plate portion to force the concentrated flavoring against the breakable seal to such a degree that the breakable seal will break allowing the concentrated flavoring to mix with water within the water bottle.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved water bottle attachment with releasable concentrated flavor which has all the advantages of the prior art bottle closure accessory devices and none of the disadvantages.

It is another object of the present invention to provide a new and improved water bottle attachment with releasable concentrated flavor which may be easily and efficiently manufactured and marketed.

It is a further object of the present invention to provide a new and improved water bottle attachment with releasable concentrated flavor which is of durable and reliable construction.

An even further object of the present invention is to provide a new and improved water bottle attachment with releasable concentrated flavor which is susceptible of a low cost of manufacture with regard to both materials and labor, and which accordingly is then susceptible of low prices of sale to the consuming public, thereby making such a water bottle attachment with releasable concentrated flavor economically available to the buying public.

Even still another object of the present invention is to provide a new and improved water bottle attachment with releasable concentrated flavor for allowing a bottle of water to be easily transformed into a flavored drink.

Lastly, it is an object of the present invention to provide a new and improved water bottle attachment with releasable concentrated flavor including a cylindrical outer casing adapted for coupling with an open upper end of a water bottle. A cylindrical inner casing is disposed within the cylindrical outer casing. An internal cylinder is disposed within the cylindrical inner casing. The internal cylinder has a diameter less than a diameter of the inner casing whereby a flow channel is formed between the internal cylinder and the inner casing. The internal cylinder has a quantity of concentrated flavoring therein. The internal cylinder has a breakable seal disposed therein preventing a downward flow of the concentrated flavoring. A liftable spout is slidably disposed within the outer casing. The liftable spout has a central aperture therethrough in communication with the flow channel. The liftable spout has a cylindrical collar extending downwardly therefrom into the narrow neck portion of the inner casing. A plunger portion is slidably disposed within the cylindrical collar of the liftable spout. The plunger portion includes a cylindrical upper portion engaged by the cylindrical collar whereby upward movement of the liftable spout will not move the plunger portion and subsequent downward movement of the liftable spout will move the plunger portion downwardly into the internal cylinder. The plunger portion includes a lower plate portion whereby the downward movement of the plunger portion will cause the lower plate portion to force the concentrated flavoring against the breakable seal to such a degree that the breakable seal will break allowing the concentrated flavoring to mix with water within the water bottle.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various figures.

DESCRIPTION OF THE PREFERRED EMBODIMENT

Figure 2:
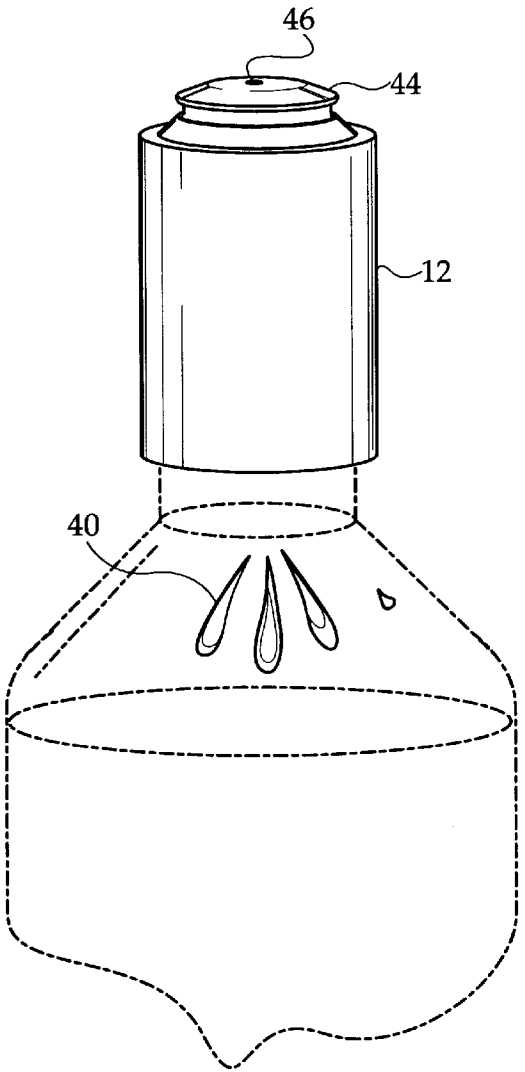
FIG. 2 is a perspective view of the present invention illustrating the release of the concentrate.
Figure 1:
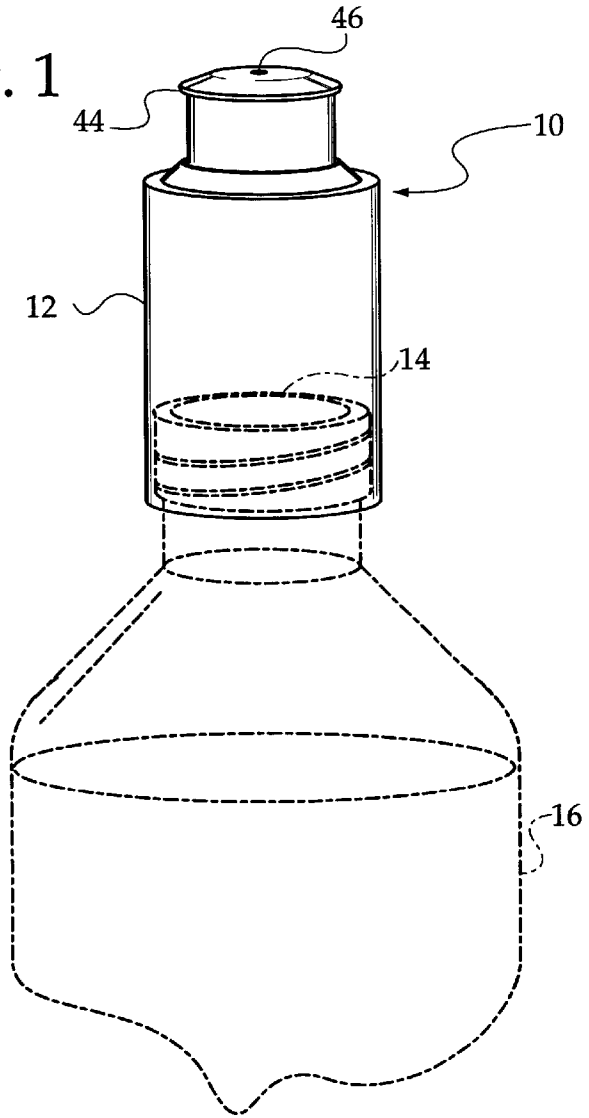
FIG. 1 is a perspective view of the preferred embodiment of the water bottle attachment with releasable concentrated flavor constructed in accordance with the principles of the present invention.
Figure 3:
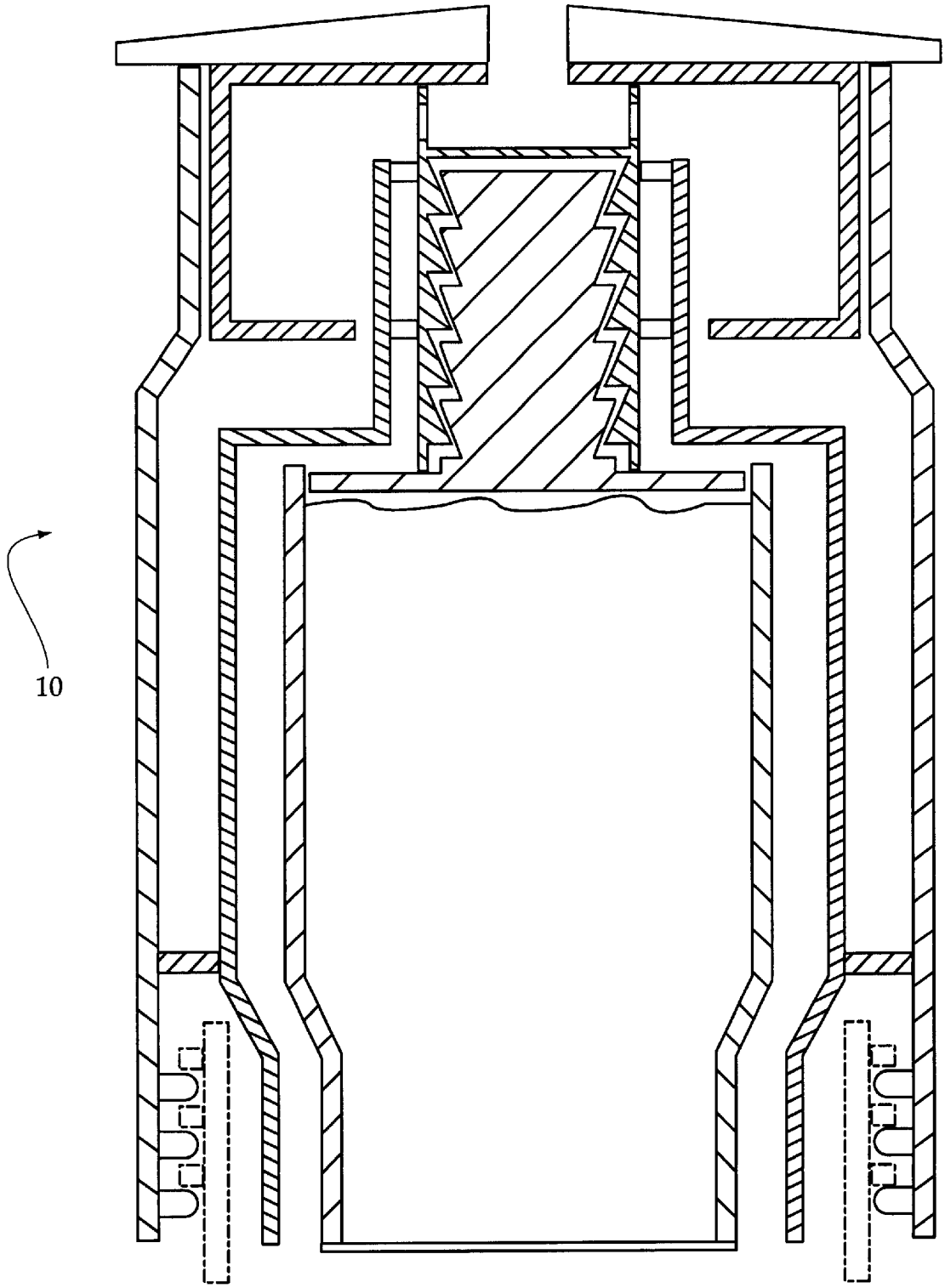
FIG. 3 is a cross-sectional side view of the present invention illustrated prior to the release of the concentrate.
Figure 4:
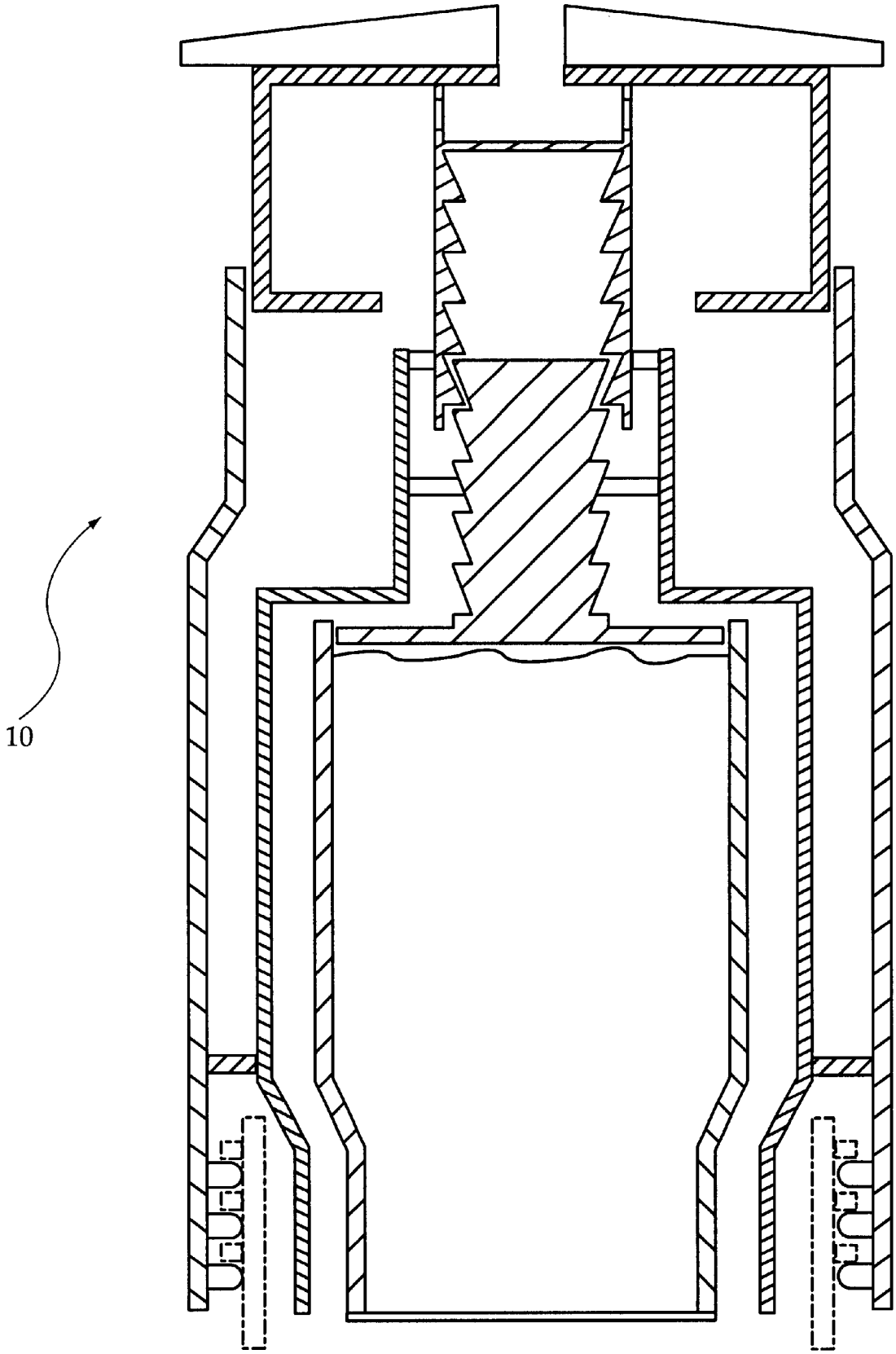
FIG. 4 is a cross-sectional side view of the present invention illustrated with the liftable spout and the plunger in a raised orientation in preparation of breaking the seal.
Figure 5:
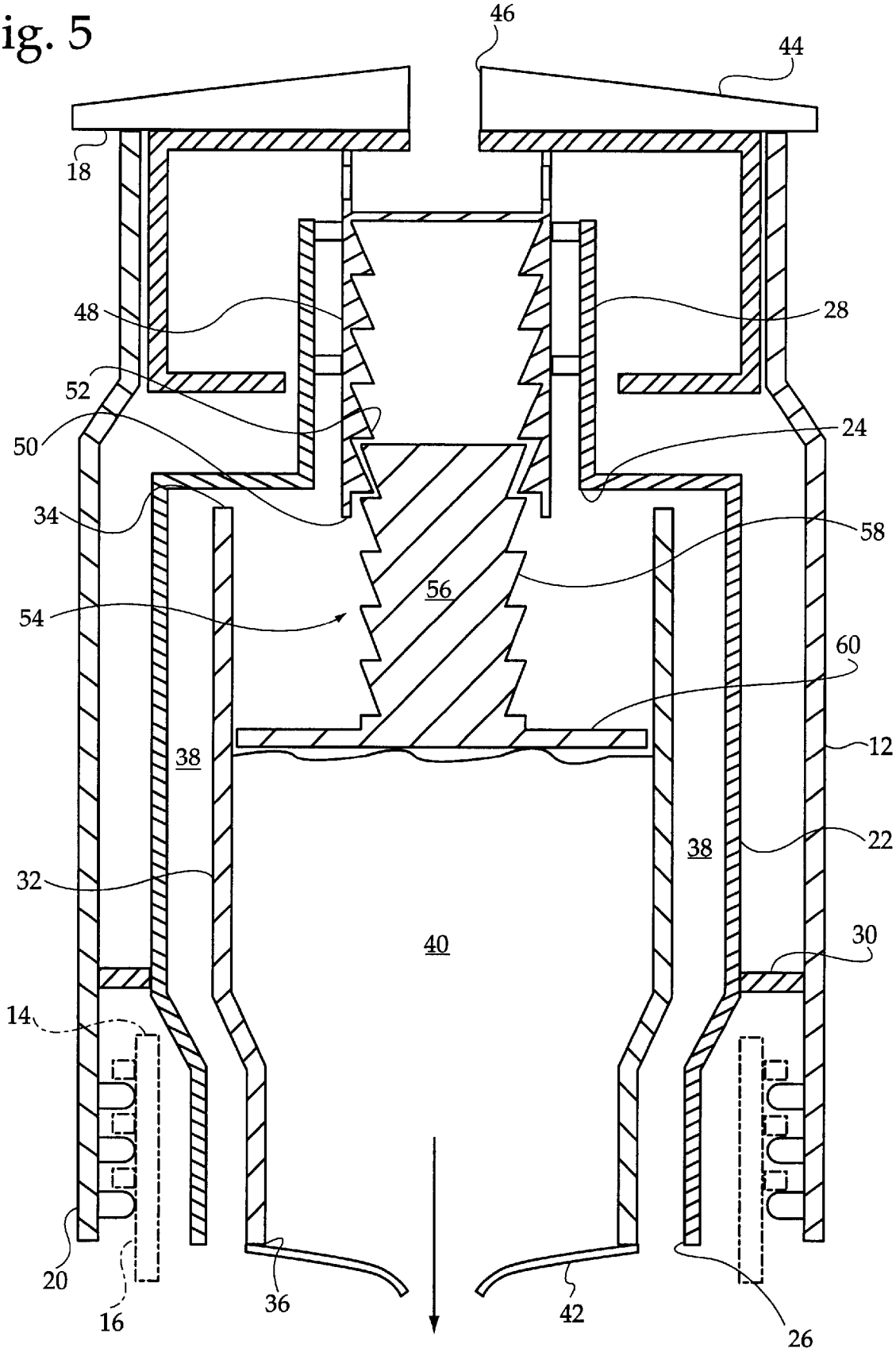
FIG. 5 is a cross-sectional side view of the present invention illustrated with the plunger forcing the concentrate out through the broken seal.
Figure 6:
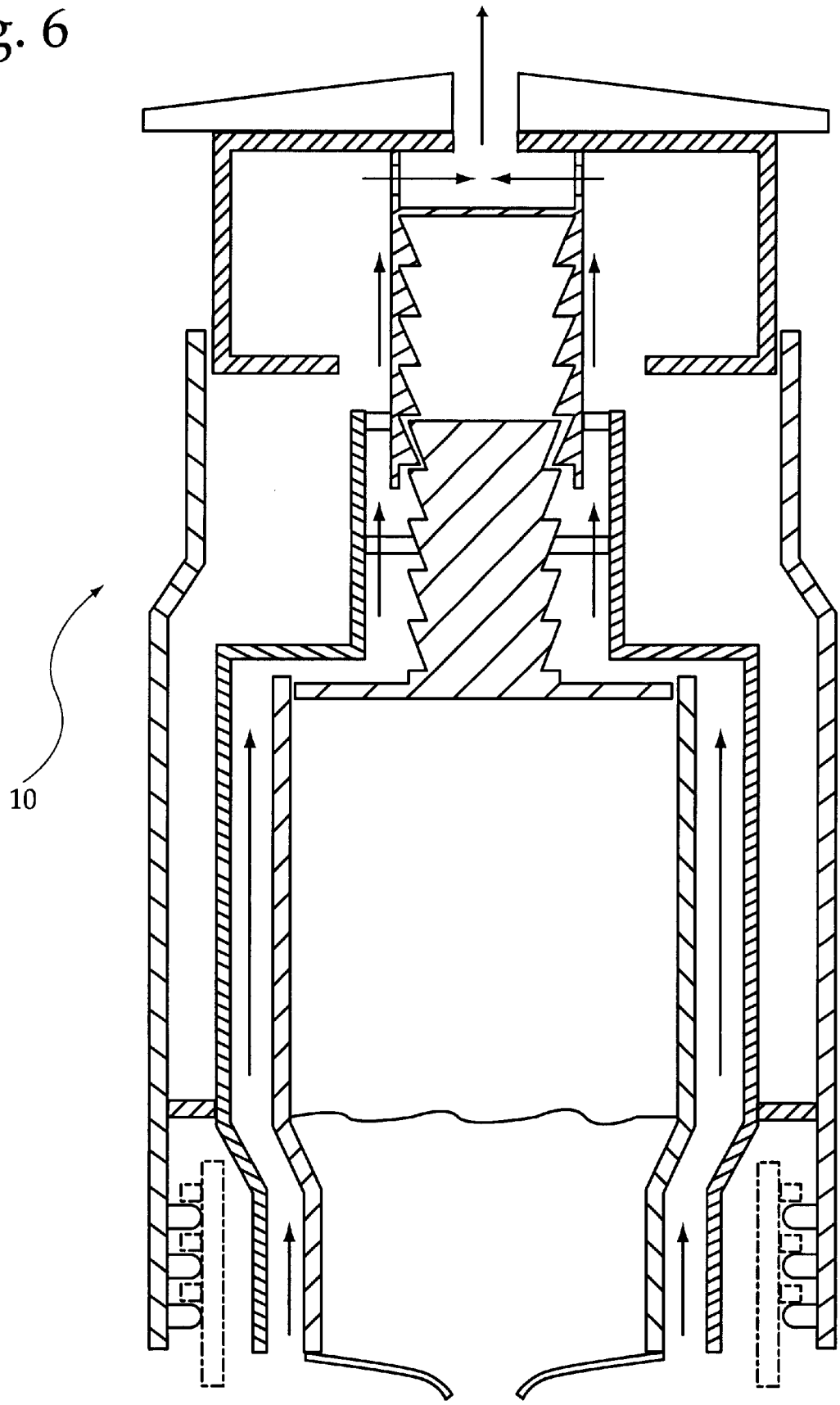
FIG. 6 is a cross-sectional side view of the present invention illustrating the outward flow of the enhanced liquid.

With reference now to the drawings, and in particular, to FIGS. 1 through 6 thereof, the preferred embodiment of the new and improved water bottle attachment with releasable concentrated flavor embodying the principles and concepts of the present invention and generally designated by the reference number 10 will be described.

Specifically, it will be noted in the various Figures that the device relates to a water bottle attachment with releasable concentrated flavor for allowing a bottle of water to be easily transformed into a flavored drink. In its broadest context, the device consists of a cylindrical outer casing, a cylindrical inner casing, an internal cylinder, a liftable spout, and a plunger portion. Such components are individually configured and correlated with respect to each other so as to attain the desired objective.

The cylindrical outer casing 12 is adapted for coupling with an open upper end 14 of a water bottle 16. The cylindrical outer casing 12 has an open upper end 18 and an open lower end 20. The open lower end 20 is internally threaded for engaging the open upper end 14 of the water bottle 16.

The cylindrical inner casing 22 is disposed within the cylindrical outer casing 12. The inner casing 22 has an open upper end 24 and an open lower end 26. The open upper end 24 has a narrow neck portion 28 extending upwardly therefrom. The inner casing 22 is secured to the outer casing 12 through the use of a plurality of circumferentially spaced apart ribs 30.

The internal cylinder 32 is disposed within the cylindrical inner casing 22. The internal cylinder 32 has an open upper end 34 and an open lower end 36. The internal cylinder 32 has a diameter less than a diameter of the inner casing 22 whereby a flow channel 38 is formed between the internal cylinder 32 and the inner casing 22. The internal cylinder 32 has a quantity of concentrated flavoring 40 therein. The open lower end 36 has a breakable seal 42 disposed therein preventing a downward flow of the concentrated flavoring 40.

The liftable spout 44 is slidably disposed within the open upper end 18 of the outer casing 12. The liftable spout 44 has a central aperture 46 therethrough in communication with the flow channel 38. The liftable spout 44 has a cylindrical collar 48 extending downwardly therefrom into the narrow neck portion 28 of the inner casing 22. The cylindrical collar 48 has an open lower end 50. The cylindrical collar 48 has annular ridges 52 extending outwardly from an interior surface thereof.

The plunger portion 54 is slidably disposed within the cylindrical collar 48 of the liftable spout 44. The plunger portion 54 includes a cylindrical upper portion 56 having annular ridges 58 extending inwardly thereof for being engaged by the annular ridges 52 of the cylindrical collar 48 whereby upward movement of the liftable spout 44 will not move the plunger portion 54 and subsequent downward movement of the liftable spout 44 will move the plunger portion 54 downwardly into the internal cylinder 32. The plunger portion 54 includes a lower plate portion 60 whereby the downward movement of the plunger portion 54 will cause the lower plate portion 60 to force the concentrated flavoring 40 against the breakable seal 42 to such a degree that the breakable seal 42 will break allowing the concentrated flavoring 40 to mix with water within the water bottle 16.

Once the concentrated flavoring 40 has been mixed with the water of the water bottle 16, the liftable spout 44 can be raised upwardly to allow the mixture to flow through the flow channel 38 and out through the central aperture 46 for drinking.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A water bottle attachment with releasable concentrated flavor for allowing a bottle of water to be easily transformed into a flavored drink comprising, in combination:

a cylindrical outer casing adapted for coupling with an open upper end of a water bottle, the cylindrical outer casing having an open upper end and an open lower end, the open lower end being internally threaded for engaging the open upper end of the water bottle;

a cylindrical inner casing disposed within the cylindrical outer casing, the inner casing having an open upper end and an open lower end, the open upper end having narrow neck portion extending upwardly therefrom;

an internal cylinder disposed within the cylindrical inner casing, the internal cylinder having an open upper end and an open lower end, the internal cylinder having a diameter less than a diameter of the inner casing whereby a flow channel is formed between the internal cylinder and the inner casing, the internal cylinder having a quantity of concentrated flavoring therein, the open lower end having a breakable seal disposed therein preventing a downward flow of the concentrated flavoring;

a liftable spout slidably disposed within the open upper end of the outer casing, the liftable spout having a central aperture therethrough in communication with the flow channel, the liftable spout having a cylindrical collar extending downwardly therefrom into the narrow neck portion of the inner casing, the cylindrical collar having an open lower end, the cylindrical collar having annular ridges extending outwardly from an interior surface thereof; and a plunger portion slidably disposed within the cylindrical collar of the liftable spout, the plunger portion including a cylindrical upper portion having annular ridges extending inwardly thereof for being engaged by the annular ridges of the cylindrical collar whereby upward movement of the liftable spout will not move the plunger portion and subsequent downward movement of the liftable spout will move the plunger portion downwardly into the internal cylinder, the plunger portion including a lower plate portion whereby the downward movement of the plunger portion will cause the lower plate portion to force the concentrated flavoring against the breakable seal to such a degree that the breakable seal will break allowing the concentrated flavoring to mix with water within the water bottle.

2. A water bottle attachment with releasable concentrated flavor for allowing a bottle of water to be easily transformed into a flavored drink comprising, in combination:

a cylindrical outer casing adapted for coupling with an open upper end of a water bottle;

a cylindrical inner casing disposed within the cylindrical outer casing;

an internal cylinder disposed within the cylindrical inner casing, the internal cylinder having a diameter less than a diameter of the inner casing whereby a flow channel is formed between the internal cylinder and the inner casing, the internal cylinder having a quantity of concentrated flavoring therein, the internal cylinder having a breakable seal disposed therein preventing a downward flow of the concentrated flavoring;

a liftable spout slidably disposed within the outer casing, the liftable spout having a central aperture therethrough in communication with the flow channel, the liftable spout having a cylindrical collar extending downwardly therefrom into the narrow neck portion of the inner casing; and a plunger portion slidably disposed within the cylindrical collar of the liftable spout, the plunger portion including a cylindrical upper portion being engaged by the cylindrical collar whereby upward movement of the liftable spout will not move the plunger portion and subsequent downward movement of the liftable spout will move the plunger portion downwardly into the internal cylinder, the plunger portion including a lower plate portion whereby the downward movement of the plunger portion will cause the lower plate portion to force the concentrated flavoring against the breakable seal to such a degree that the breakable seal will break allowing the concentrated flavoring to mix with water within the water bottle.

3. The water bottle attachment with releasable concentrated flavor as set forth in claim 2, wherein the cylindrical outer casing has an internally threaded open lower end for engaging the open upper end of the water bottle.

4. The water bottle attachment with releasable concentrated flavor as set forth in claim 2, wherein the cylindrical collar of the liftable spout has annular ridges extending outwardly from an interior surface thereof and the cylindrical upper portion of the plunger portion has annular ridges extending inwardly thereof for being engaged by the annular ridges of the cylindrical collar whereby the upward movement of the liftable spout will not move the plunger portion and subsequent downward movement of the liftable spout will move the plunger portion downwardly into the internal cylinder.

* * * * *